US010875615B1

(12) United States Patent
Monroe et al.

(10) Patent No.: US 10,875,615 B1
(45) Date of Patent: Dec. 29, 2020

(54) SYSTEMS AND METHODS FOR REDUCING POROSITY IN PROPELLERS

(71) Applicant: Brunswick Corporation, Mettawa, IL (US)

(72) Inventors: Alexander K. Monroe, St. Cloud, WI (US); Trevor George, Eldorado, WI (US); Philip R. Walker, Oshkosh, WI (US); Daniel J. Guse, Fond du Lac, WI (US); Justin D. Ericson, St. Cloud, WI (US); Jason Worful, Plymouth, MI (US)

(73) Assignee: Brunswick Corporation, Mettawa, IL (US)

( * ) Notice: Subject to any disclaimer, the term of this patent is extended or adjusted under 35 U.S.C. 154(b) by 148 days.

(21) Appl. No.: 16/105,372

(22) Filed: Aug. 20, 2018

(51) Int. Cl.

| | |
|---|---|
| ***B63H 1/20*** | (2006.01) |
| ***B63B 71/00*** | (2020.01) |
| ***B63H 1/14*** | (2006.01) |
| ***B63H 20/26*** | (2006.01) |
| *B63H 1/26* | (2006.01) |

(52) U.S. Cl.
CPC ..... *B63H 1/20* (2013.01); *B63B 71/00* (2020.01); *B63H 1/14* (2013.01); *B63H 20/26* (2013.01); *B63H 1/26* (2013.01)

(58) Field of Classification Search
CPC ... B63H 1/26; B63H 1/20; B63H 1/14; B63H 1/15; B63H 20/245; B63H 20/26
USPC ..... 416/93 A
See application file for complete search history.

(56) References Cited

U.S. PATENT DOCUMENTS

| | | | | | |
|---|---|---|---|---|---|
| 3,467,051 | A * | 9/1969 | Shimanckas | B63H 20/245 | 440/89 R |
| 3,563,670 | A * | 2/1971 | Knuth | B63H 1/20 | 416/93 R |
| 3,701,611 | A * | 10/1972 | Lambrecht | B63H 1/20 | 416/134 R |
| 3,788,267 | A * | 1/1974 | Strong | B63H 1/18 | 440/66 |
| 3,865,509 | A * | 2/1975 | Frazzell | B63H 1/28 | 416/93 R |
| 3,871,324 | A * | 3/1975 | Snyder | B63H 21/28 | 440/55 |
| 3,876,332 | A * | 4/1975 | Kashmerick | B63H 23/34 | 416/93 R |
| 3,952,686 | A * | 4/1976 | Pichl | B63H 20/32 | 440/83 |

(Continued)

*Primary Examiner* — Eldon T Brockman
*Assistant Examiner* — Wesley Le Fisher
(74) *Attorney, Agent, or Firm* — Andrus Intellectual Property Law, LLP

(57) ABSTRACT

A method of making a propeller includes forming the propeller to have blades coupled to an outer hub, the outer hub coupled to an inner hub via ribs, and the inner hub configured to be coupled to the marine vessel. The ribs each have first and second ends with a midpoint therebetween, an inner end and an outer end that define a width therebetween, and a leading surface and a trailing surface that define a thickness therebetween. The ribs are tapered such that the thickness is greater at the midpoint than at least at one of the first end and the second end, and scalloped such that the width is greater at the midpoint than at least at one of the first end and the second end. Each of the ribs is coupled to the outer hub in radial alignment with one of the blades.

20 Claims, 11 Drawing Sheets

(56) References Cited

U.S. PATENT DOCUMENTS

| | | | | |
|---|---|---|---|---|
| 4,511,339 | A * | 4/1985 | Kasschau | B63H 20/245 416/93 A |
| 4,778,419 | A * | 10/1988 | Bolle | B63H 20/245 416/134 R |
| 4,842,483 | A * | 6/1989 | Geary | B63H 23/34 416/93 A |
| 5,423,701 | A * | 6/1995 | Rodskier | B63H 5/10 416/93 A |
| 6,123,539 | A | 9/2000 | Miller | |
| 6,427,759 | B1 | 8/2002 | Bauer et al. | |
| 7,347,905 | B1 | 3/2008 | Donahue et al. | |
| 2002/0009367 | A1* | 1/2002 | Chen | B63H 23/34 416/134 R |
| 2010/0074756 | A1* | 3/2010 | Lin | B63H 1/20 416/223 R |
| 2015/0336647 | A1* | 11/2015 | Ariga | B63H 1/15 416/146 R |
| 2019/0061892 | A1* | 2/2019 | Choi | F01D 5/282 |

* cited by examiner

SYSTEMS AND METHODS FOR REDUCING POROSITY IN PROPELLERS

FIELD

The present disclosure generally relates to systems and methods for reducing porosity in propellers, and more particularly to systems and methods for reducing porosity in propellers by aligning and configuring ribs to prevent porosity caused by shrinkage during casting.

BACKGROUND

The Background and Summary are provided to introduce a foundation and selection of concepts that are further described below in the Detailed Description. The Background and Summary are not intended to identify key or essential features of the claimed subject matter, nor are they intended to be used as an aid in limiting the scope of the claimed subject matter.

The following U.S. patents are incorporated herein by reference:

U.S. Pat. No. 6,123,539 discloses a die assembly apparatus that is provided with a plurality of die segments that move on guides from open to closed positions. Movement from the open to the closed positions for each die segment is along the path that extends inward toward a central axis and toward a base plate. A compression member provides a retaining force along the central axis to compress the die segments between limited surface areas at the top and bottom portions of the die segments. Molten wax is injected into an injection port so that the molten wax is first introduced into the die cavity at the bottom portion of the die cavity. Hydraulic actuators are used to move the die segments from the open to the closed positions and vice versa.

U.S. Pat. No. 6,427,759 discloses an investment cast stainless steel article, such as a marine propeller, is composed of a stainless steel alloy containing from 14.5 to 15.2% chromium, 5.35% to 6.05% nickel and 1.0% to 1.5% silicon. During the investment casting procedure, the increased silicon in the stainless steel lowers the driving force for the silicon from reacting with the molten metal, thereby reducing casting defects and decreasing the time and labor required for final grinding and polishing of the propeller.

U.S. Pat. No. 7,347,905 discloses an aluminum-silicon lost foam casting alloy having reduced microporosity and a method for casting the same. A preferred lost foam cast alloy consists essentially of 6 to 12% by weight silicon and preferably 9.0 to 9.5% by weight silicon, 0.035-0.30% strontium, 0.40% maximum iron, 0.45% maximum copper, 0.49% maximum manganese, 0.60% maximum magnesium, 3.0% maximum zinc, and the balance aluminum. Most preferably, the lost foam alloy is free from iron, titanium and boron. However, such elements may exist at trace levels. Most preferably, the alloy is lost foam cast with the process that applies at least 10 atmospheres of pressure during solidification. However, the range may be 5 to 60 atmospheres. The strontium addition is greater than 0.005% by weight and most preferably greater than 0.05% by weight. Alloys having substantially decreased tensile liquid failure defects and substantially decreased surface puncture defects in comparison to conventional lost foam cast aluminum silicon alloys are obtained. Further, hydrogen porosity formation is substantially or completely suppressed and surface porosity defects are substantially decreased in comparison to conventional lost foam silicon alloys when casting lost foam cast alloys.

SUMMARY

One embodiment of the present disclosure generally relates to a method of making a propeller for a marine vessel. The method includes forming the propeller to have blades coupled to an outer hub, where each of the blades is coupled to the outer hub. The method further includes forming the propeller such that the outer hub is coupled to an inner hub via ribs, where the inner hub is configured to be coupled to the marine vessel. The ribs each have a first end and a second end that define a length therebetween. A midpoint is further defined between the first end and the second end. The ribs each have an inner end and an outer end that define a width therebetween, and the ribs each have a leading surface and a trailing surface that define a thickness therebetween. The method further includes forming each of the ribs to be tapered such that the thickness is greater at the midpoint than at least at one of the first end and the second end, and forming each of the ribs to be scalloped such that the width is greater at the midpoint than at least at one of the first end and the second end. The method further includes forming the propeller such that each of the ribs is coupled to the outer hub to be radially aligned with one of the blades.

Another embodiment generally relates to a propeller for a marine vessel having an inner hub configured to be coupled to the marine vessel, an outer hub, and a plurality of ribs that couple the outer hub to the inner hub. The ribs each have a first end and a second end that define a length therebetween, with a midpoint is further defined between the first end and the second end. The ribs each have an inner end and an outer end that define a width therebetween, where the width is greater at the midpoint than at least at one of the first end and the second end such that the ribs are scalloped. The ribs each have a leading surface and a trailing surface that define a thickness therebetween. The thickness greater at the midpoint than at least at one of the first end and the second end such that the ribs are tapered. A plurality of blades is coupled to the outer hub. Each of the ribs is coupled to the outer hub in radial alignment with one of the blades.

Another embodiment generally relates to a method of making a propeller for a marine vessel. The method includes forming the propeller to have blades coupled to an outer hub, and forming the propeller such that the outer hub is coupled to an inner hub via ribs. The inner hub is configured to be coupled to the marine vessel. The ribs each have a forward end and an aft end that define a length therebetween, where a midpoint is further defined between the forward end and the aft end. The ribs each have an inner end and an outer end that define a width therebetween, where each of the ribs has a leading surface and a trailing surface that define a thickness therebetween. The method further includes forming the ribs to be tapered such that the thickness decreases at a first rate between the forward end and the midpoint and decreases at a second rate between the midpoint and the aft end, where the second rate is greater than the first rate. The method further includes forming each of the ribs to be scalloped such that the width continuously increases from the aft end to the forward end. The method further includes forming the propeller such that each of the blades has a blade width divided into even thirds, and each of the ribs is radially aligned with a center third of the even thirds of one of the blades.

Various other features, objects and advantages of the disclosure will be made apparent from the following description taken together with the drawings.

BRIEF DESCRIPTION OF THE DRAWINGS

The drawings illustrate embodiments for carrying out the disclosure. The same numbers are used throughout the drawings to reference like features and like components. In the drawings.

DETAILED DISCLOSURE

This written description uses examples to disclose embodiments of the present disclosure and also to enable any person skilled in the art to practice or make and use the same. The patentable scope of the invention is defined by the claims and may include other examples that occur to those skilled in the art. Such other examples are intended to be within the scope of the claims if they have structural elements that do not differ from the literal language of the claims, or if they include equivalent structural elements with insubstantial differences from the literal language of the claims.

In the present description, certain terms have been used for brevity, clarity, and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives, and modifications are possible within the scope of the appended claims. Each limitation in the appended claims is intended to invoke interpretation under 35 USC § 112(f), only if the terms "means for" or "step for" are explicitly recited in the respective limitation.

Figure 1:
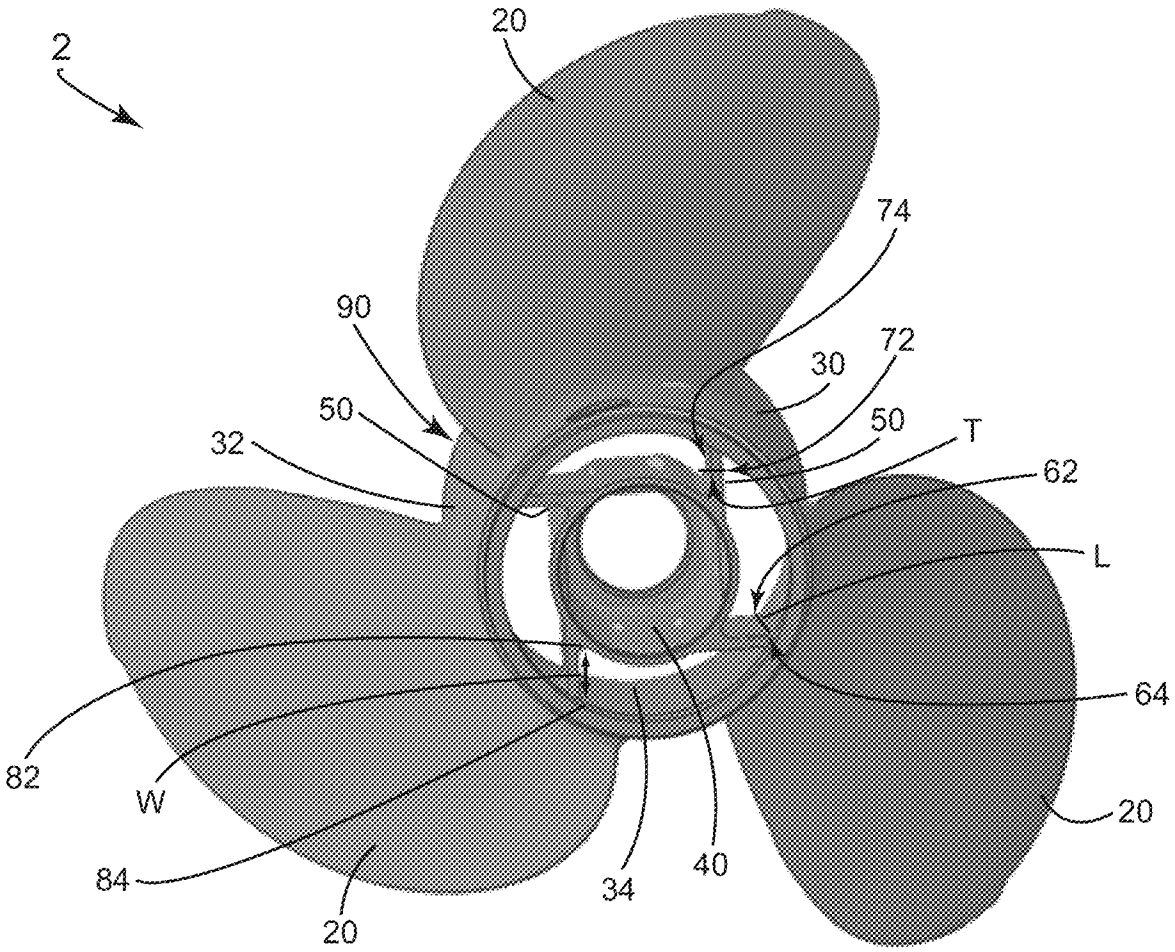
FIG. 1 PRIOR ART
FIG. 1 is an isometric view of the forward side of a propeller known in the art.

The present disclosure generally relates to systems and methods for making a propeller for a marine vessel. An exemplary propeller for a marine vessel known in the art is shown in FIG. 1. The prior art propeller 2 includes three blades 20 that are each coupled to an outer surface 32 of an outer hub 30, which is coupled to an inner hub 40 by four ribs 50. In particular, each rib 50 has an outer end 84 coupled to an inner surface 34 of the outer hub 30, and an opposite inner end 82 that is coupled to the inner hub 40. A width W is defined between the outer end 84 and the inner end 82. The inner hub 40 is configured to be coupled to the marine vessel in a manner known in the art.

Each of the ribs 50 further extends between a first end 62 and a second end 64, which defines a length L therebetween. In the embodiment shown, the first end 62 is closer to the diffuser ring 90 than the second end 64. Similarly, each of the ribs 50 is defined as having a leading surface 72 and a trailing surface 74 to define a thickness T therebetween. As with the first end 62 and the second end 64, the leading surface 72 and trailing surface 74 may also be reversed, but are adopted as labels for clarity in the present disclosure.

It should be recognized that while the diffuser ring 90 is generally described herein as being integrally formed with the propeller 10, this and other components disclosed herein may also be subsequently coupled through methods known in the art. Certain embodiments according to the present disclosure also lack a diffuser ring 90, but nonetheless refer to the diffuser ring 90 as a common landmark near the aft end of the propeller 10.

Figure 2:
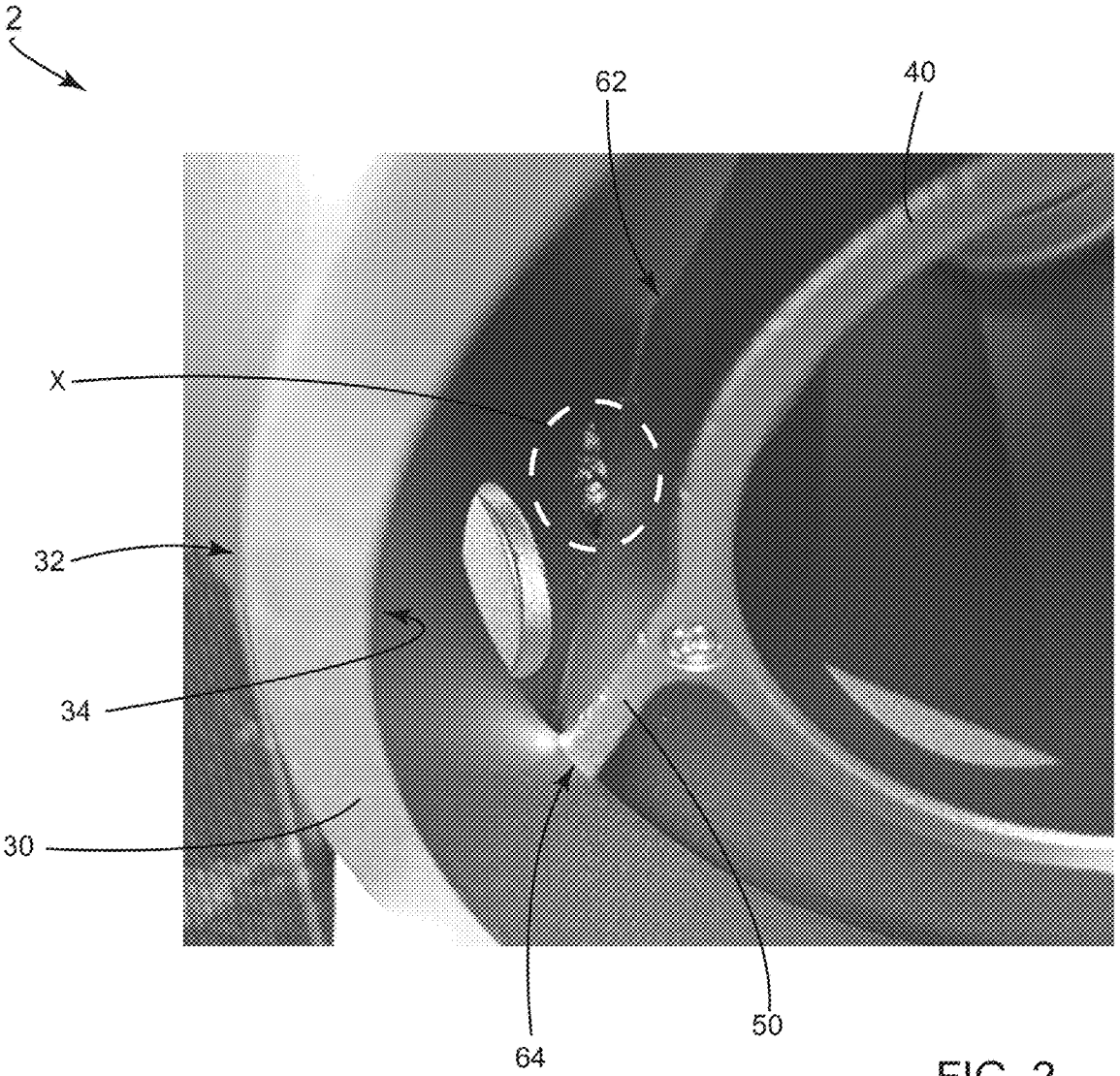
FIG. 2 PRIOR ART
FIG. 2 is a close-up photograph of the forward side of an actual propeller known in the art, showing porosity defects from shrinkage during molding.

Through experimentation and development, the present inventors have identified that systems and methods for making prior art propellers 2, which include a casting process known in the art, have an issue with porosity due to shrinkage. In particular, the designs of prior art propellers 2 frequently suffer from defects X caused by porosity due to shrinkage in the propeller materials during the casting process, as shown in the photograph of FIG. 2. In particular, the present inventors have identified that one cause of porosity results from the pool of liquid metal being shut off from the liquid riser due to premature solidification, which is discussed further below. The resultant porosity causes significant rework and repair in the manufacturing process, and may also lead to failure and durability concerns in the field.

Compromises are made around casting temperature in order to contain and minimize the porosity. The porosity causes significant rework and repair, which causes significant variation in blade pitch, which in turn can cause vibration. The repair can also leave sub surface defects that can be sources for durability failures. Propellers that do not show symptoms of shrink are also likely to have sub surface defects that can cause durability issues. In addition, consideration for shell removal after casting can also complicate the design.

The root cause for shrink porosity is that there is a section of the casting that is still molten while the feed line back to the pouring cup is solidifying (also referred to as freezing off). Once the puddle of molten steel solidifies, it shrinks and requires molten steel to feed the gap created. If the feed is shut off, it tears away from the solid steel around it and creates a significant amount of porosity.

Traditionally, effort is taken to avoid putting thick ribs in contact with the blade as it creates a very large cross section, which takes even longer to solidify the root. As discussed above, the present disclosure adopts a different approach.

The presently disclosed propeller 10 and methods for its creation include three primary features, which are discussed further below. In certain embodiments, each rib 50 has aggressive tapering 70 in the section where the blade 20 is expected to intersect the rib 50, whereby the precise intersection depends on pitch. The taper is therefore less aggressive where the blade 20 is not expected to intersect, forming a compound taper. This creates a tendency to solidify from bottom to top as desired. Scalloping 60 creates a secondary taper, which is quite aggressive for cross section reduction to keep the feed path open longer, specifically by solidifying from bottom to top as desired. Finally, placement of the rib 50 is aimed for the "thermal center" of each blade 20. In certain embodiments, the target is to be at or near the thickest region 24 of the blade 20. This again creates a tendency to solidify from thin to thick on the blade 20, thereby preventing porosity.

Figure 3A:
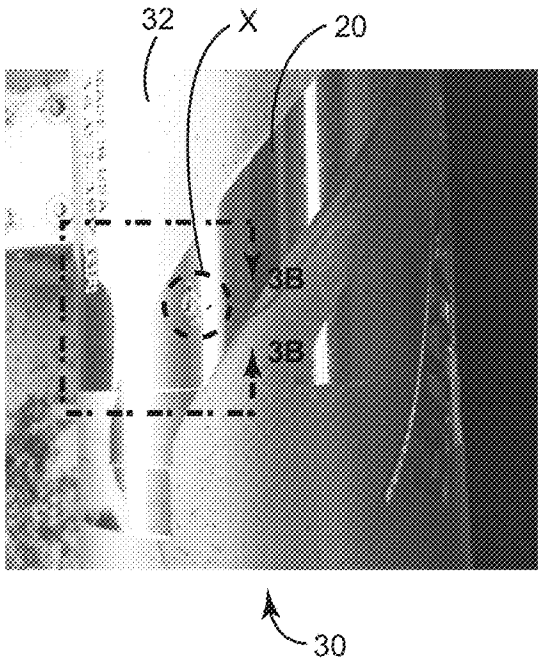
FIG. 3A PRIOR ART
FIGS. 3A and 3B are photographs of the side of another propeller known in the art with the propeller blades removed to show further porosity damage.
Figure 3B:
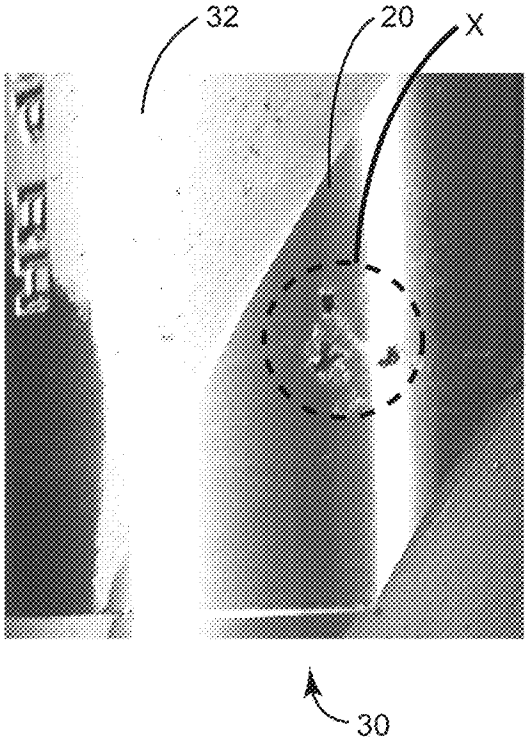
FIG. 3B PRIOR ART

FIGS. 3A and 3B further depict another exemplary defect X common among prior art propellers 2. In the photographs shown, the blade 20 has been removed to expose defects X that would otherwise not be visible from the exterior.

Figure 4:
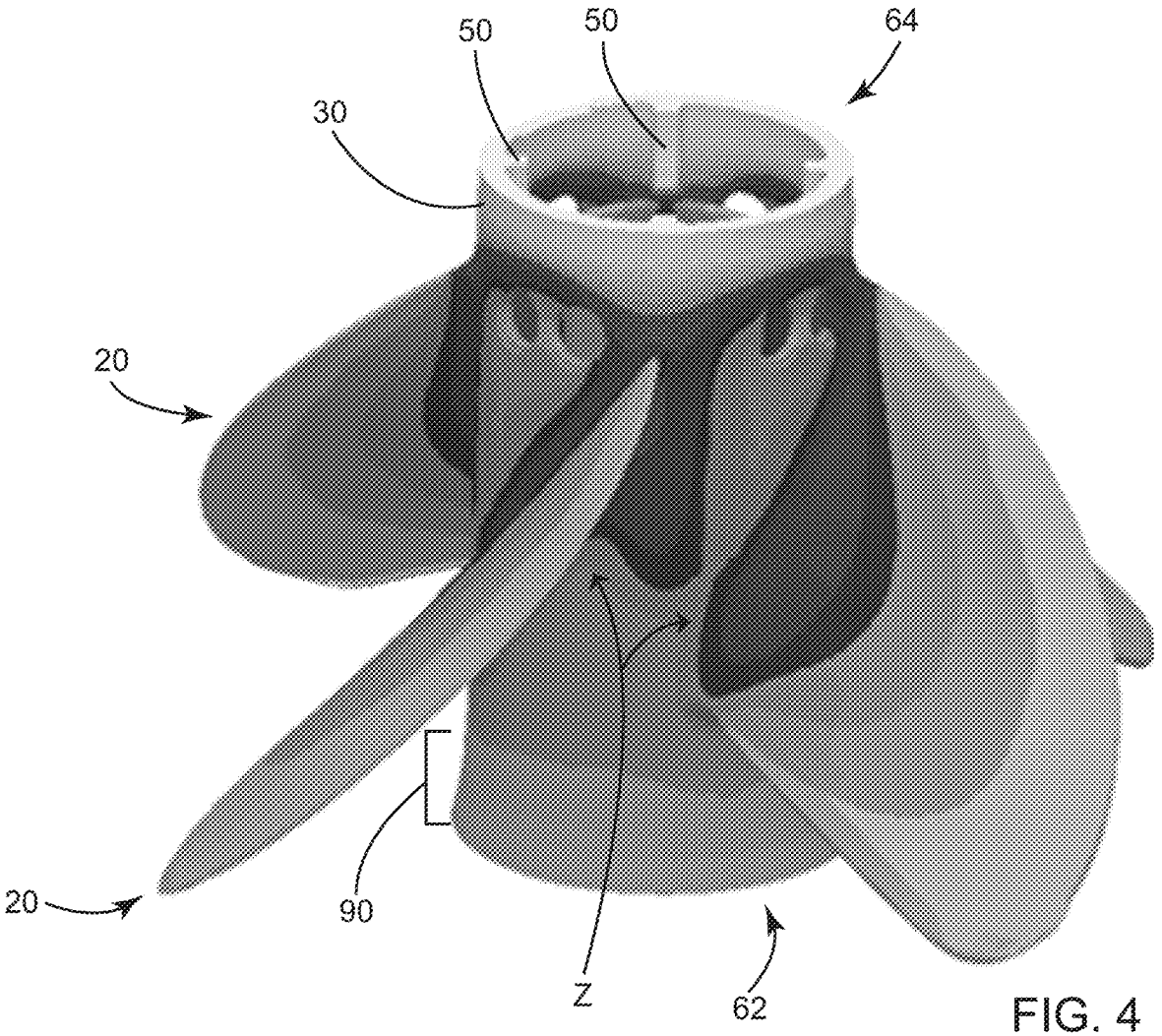
FIG. 4 PRIOR ART
FIG. 4 is an isometric, side view of a model revealing isolated liquid pockets during the casting process that lead to increased porosity for a propeller known in the art.

Additionally, the present inventors have developed the model shown in FIG. 4, which reveals dark, isolated liquid pockets Z within prior art propellers 2 where the liquid metal was shut off from the liquid riser to premature solidification. These isolated liquid pockets Z correspond to regions of increased porosity due to the shut off supply of material available as the isolated liquid pockets Z cool and shrink.

Figure 5:
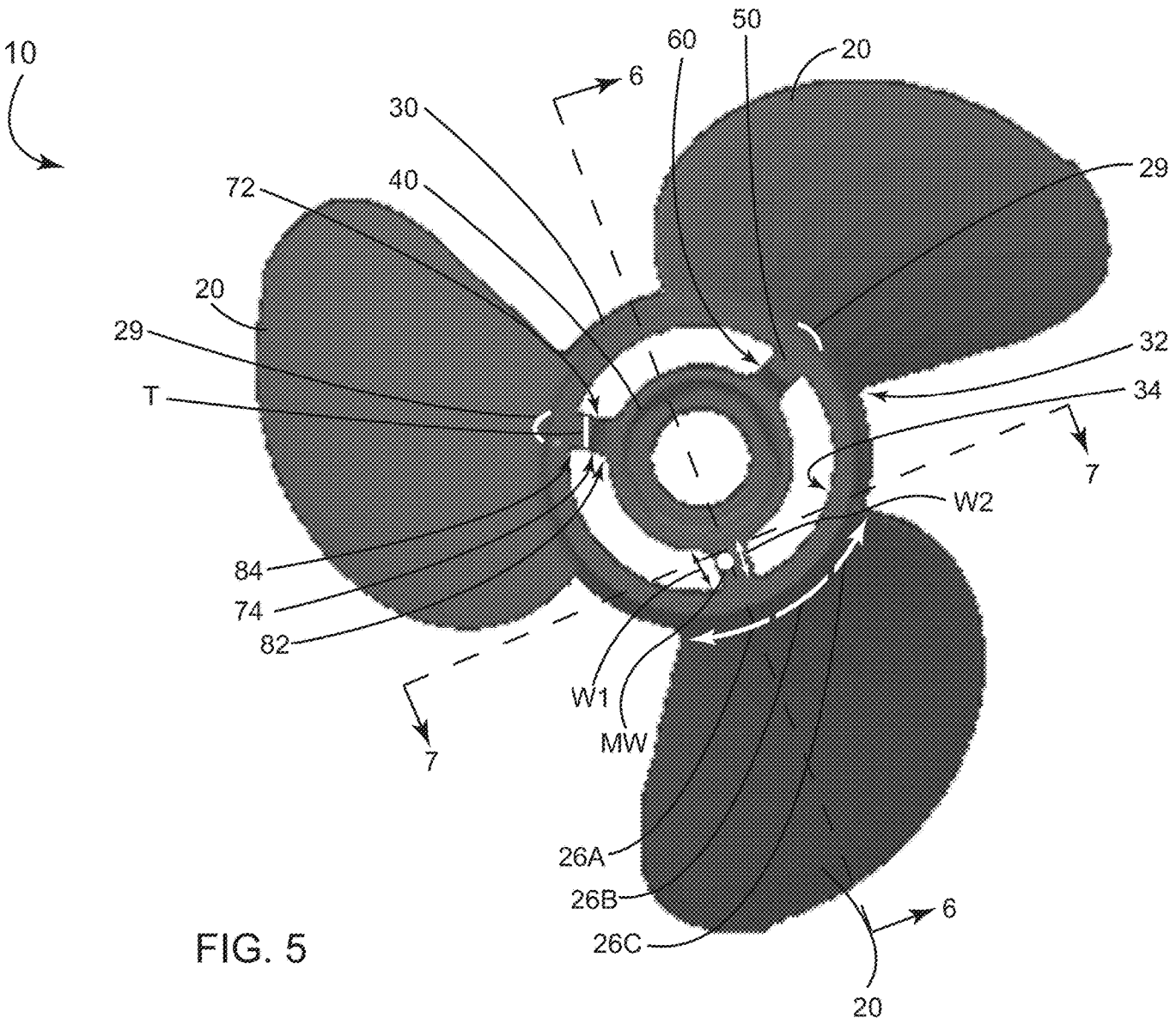
FIG. 5 is a view from the aft side of a propeller according to the present disclosure.

FIGS. 5-8 depict exemplary embodiments of propellers 10 made in accordance with the present disclosure. The propeller 10 shown has three blades 20 corresponding to three ribs 50, though other configurations are also anticipated by the present disclosure. By way of example, the present disclosure would also produce reduced porosity for a propeller 10 having four blades 20 with four ribs 50. As previously discussed, the blades 20 are coupled to an outer surface 32 of an outer hub 30 and the ribs 50 are coupled at an inner surface 34 of the outer hub 30 to couple the outer hub 30 to the inner hub 40. In contrast to the prior art propeller 2 shown in FIG. 1, the ribs 50 and blades 20 are provided in a 1:1 ratio, which as discussed below provides advantages for the reduction of porosity and other defects during the molding process. This is further shown in the FIG. 5 depiction of a blade alignment position 29 that is radially aligned to each of the ribs 50, but on the outer surface 32 of the outer hub 30 opposite the corresponding position on the inner surface 34 coupled to the rib 50. In this manner, the propeller 10 depicted in FIG. 5 is configured such that each of the blades 20 is coupled to the outer hub 30 to overlap this blade alignment position 29. In addition to providing structural support for the deflections of the blades 20, the present inventors have identified that by aligning each rib 50 to a blade 20, the solidification profile of the molding process is improved, and porosity defects X are reduced. In certain embodiments, the present inventors have identified particular benefits with aligning the ribs 50 to the thermal center of the blade 20. In certain embodiments, this corresponds to aligning the rib 50 to a central portion (such as a central third of an evenly divided blade width) and/or the thickest region 24 of a blade 20, which often corresponds to the position having the greatest thermal mass or being within the thermal center of the blade 20.

As previously discussed with respect to the prior art propeller 2 shown in FIG. 1, the propeller 10 of the present disclosure has ribs 50 that are defined between a first end 62 and a second end 64 defining a length L therebetween, a leading surface 72 and a trailing surface 74 defining a thickness T therebetween, and an inner end 82 opposite an outer end 84 defining a width W therebetween. It will be recognized that the lengths L, thicknesses T, and widths W as used herein vary across each rib 50, which are depicted as lengths L1-L3, thicknesses T1-T3, and widths W1-W3. An infinite number of lengths L, thicknesses T, and/or widths W are possible. However, for the purposes of clarity, length L1, thickness T1, and width W1 will generally be used to indicate the greatest of these values for a given rib 50, the length L3, thickness T3, and width W3 will generally be used to depict a minimum value for each measurement of a given rib 50, and the length L2, thickness T2, and width W2 will be used to represent an intermediate measurement between the minimum and maximum previously discussed for a given rib 50. In certain examples, a midpoint 68 (see FIG. 6) positioned between the first end 62 and the second end 64, a center plane CP (see FIG. 7) between the leading surface 72 and trailing surface 74, and a midwidth MW between the inner end 82 and the outer end 84 are referenced as demonstrative positions of intermediate values within each of these dimensions of the rib 50.

In certain embodiments, each blade 20 is evenly divided into thirds 26A-26C, whereby each rib 50 is formed to be in alignment with the center third 26B of one of the blades 20. In other embodiments, the ribs 50 are formed such that the blade alignment position 29 corresponds to a thickest region 24 or another position corresponding to the thermal center of a blade 20, which again has advantages for the reduction of shrinkage and porosity in the molding process.

Figure 6:
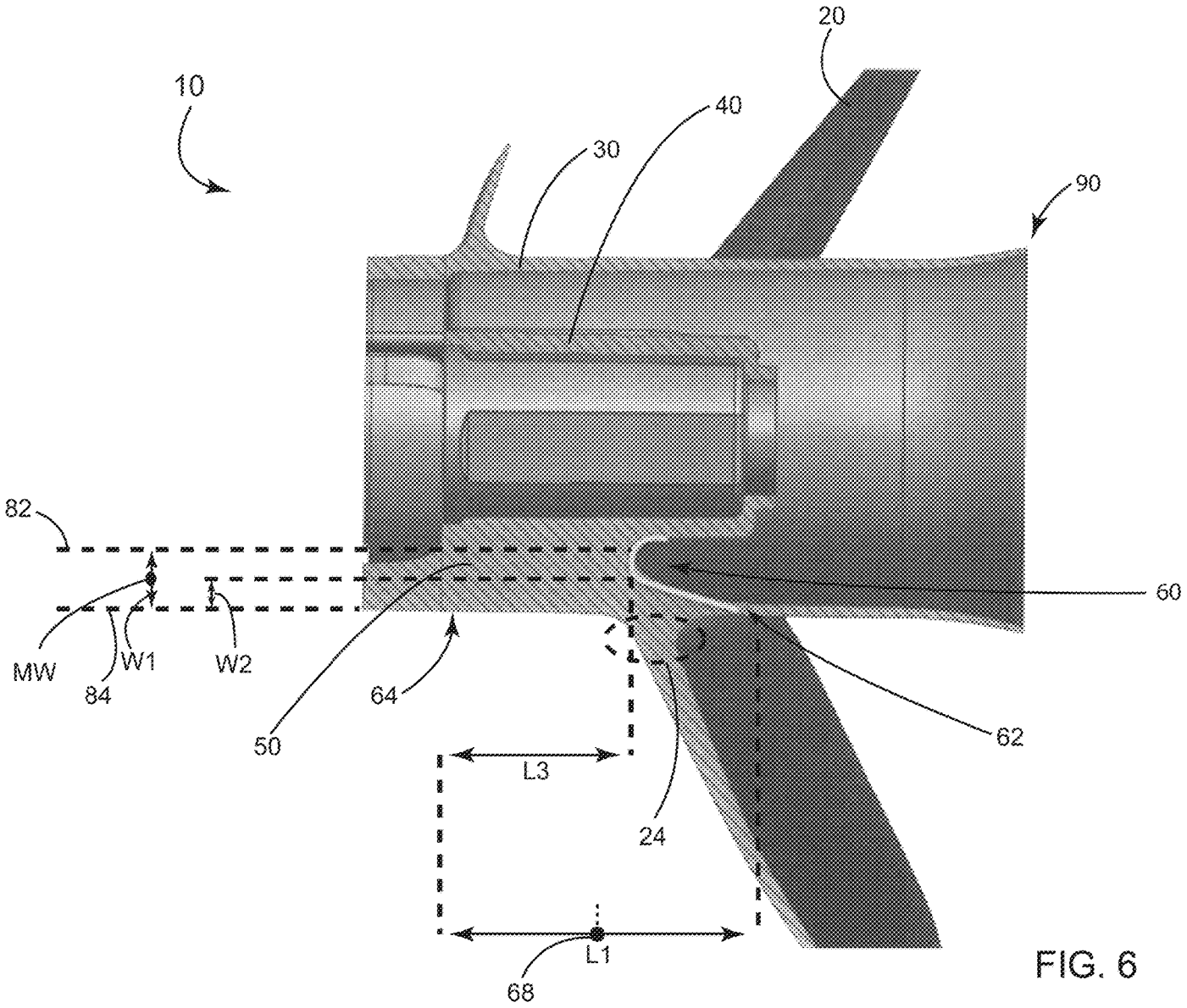
FIGS. 6 and 7 are sectional views taken from the propeller of FIG. 5.

FIG. 6 depicts a cross sectional view taken along the line 6-6 through one of the ribs 50 in the propeller 10 depicted in FIG. 5. In particular, FIG. 6 depicts additional formation features for the ribs 50 in accordance with the present disclosure. The material shown for the rib 50 does not have a rectangular cross section, but has a scallop shaped cut-out or reduction of material between the inner end 82 and the outer end 84, and between the first end 62 and second end 64. In this manner, the rib 50 shown has a length L1 where the rib 50 is coupled to the outer hub 30, and a length L3 where the rib 50 is coupled to the inner hub 40. Likewise, the rib 50 has a width W1 where the rib 50 fully extends between the outer hub 30 and the inner hub 40 at the second end 64. The rib 50 also has a width W2 taken at the midpoint 68 between the first end 62 and the second end 64 that is less than the width W1.

In certain embodiments, it can be said that this scalloping 60 appears as a continuous, concaved curve opening towards the aft end of the propeller 10. The radius of such a continuous curve may be uniform or non-uniform across the rib. These and other embodiments may further be described as incorporating scalloping 60 having a J-shape, a U-shape, a V-shape, or the like. In the embodiment shown in FIG. 6, the continuous curve of the scalloping 60 curves towards the forward end of the propeller 10 from the outer end 84 of the rib 50 where the rib 50 is coupled to the outer hub 30 towards the midwidth MW of the rib 50. The continuous curve of the scalloping 60 then curves towards the aft end of the propeller 10 again from the midwidth MW of the rib 50 towards the inner end 82 of the rib 50 where the rib 50 is coupled to the inner hub 40. It should be recognized that further embodiments are also anticipated by the present disclosure, including linear, exponential, and other slopes between the outer end 84 and the inner end 82 of the rib 50.

The present inventors have identified that by controlling the volume of material comprising the rib 50 through scalloping 60, tapering 70, and alignment with the blades 20, an improved solidification and cooling profile is provided during casting, thereby reducing porosity during the formation of the propeller 10. In particular, the systems and methods disclosed herein impact the time and direction of solidification to eliminate the creation of the isolated liquid pockets Z discussed above.

FIG. 6 further discloses the ribs 50 being formed to couple with the outer hub 30 in alignment with the thickest region 24 of the blade 20, as previously discussed. This provides further benefits for the reduction of porosity by extending the time for solidification within this material-dense region of the propeller 10, preventing the creation of isolated liquid pockets Z.

Figure 7:
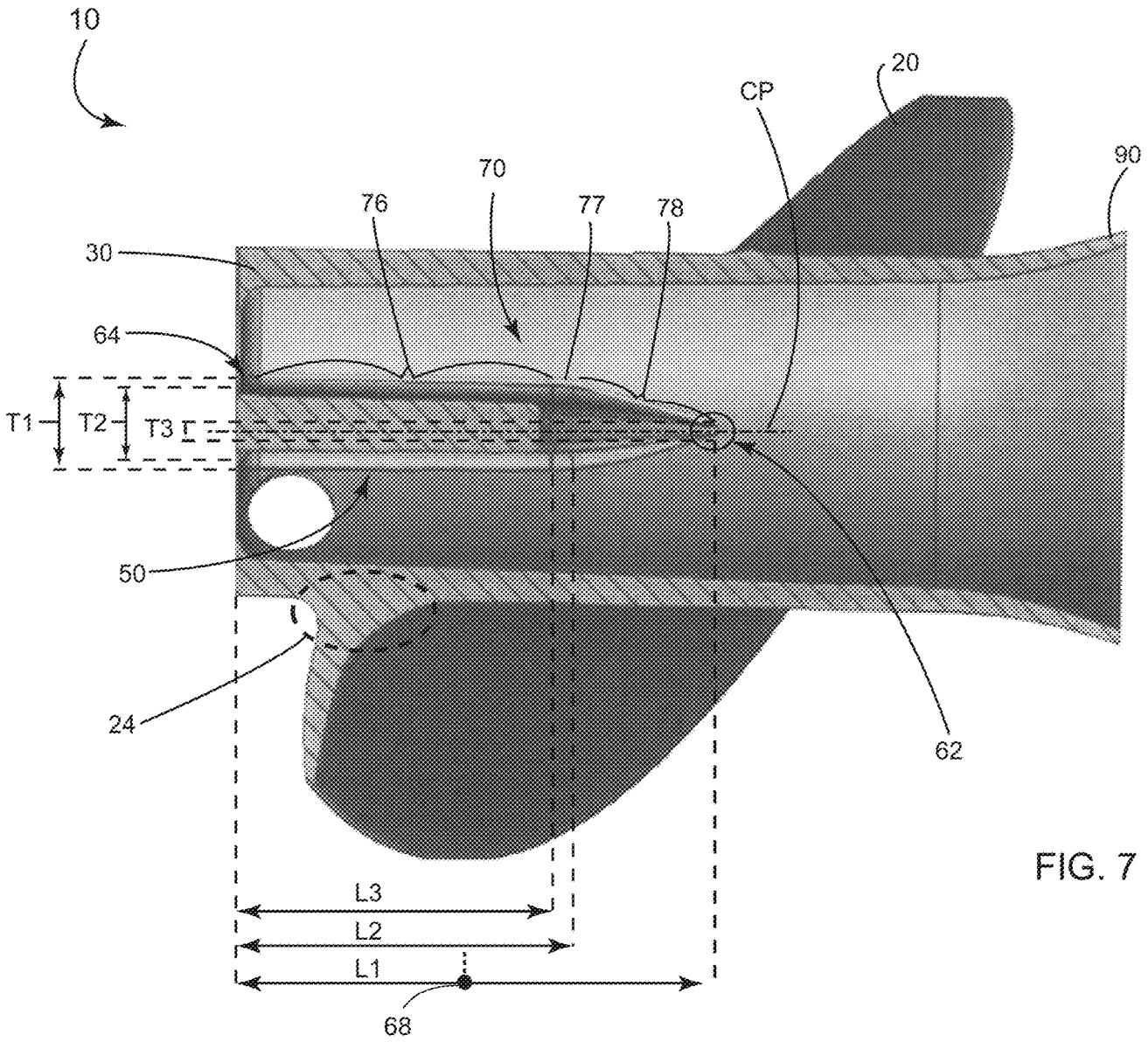

FIG. 7 depicts a cross sectional view taken along the line 7-7 for the propeller 10 shown in FIG. 5. FIG. 7 depicts tapering 70 of the ribs 50 between the leading surface 72 and the trailing surface 74 from the second end 64 to the first end 62. In the embodiment shown, the propeller 10 has ribs 50 having a thickness T1 at the second end 64, a thickness T2 at a transition point 77 between the first end 62 and the second end 64, and a thickness T3 at the first end 62 of the rib 50. As previously stated, it should be recognized that any number of thicknesses T are anticipated by the present disclosure, whereby the present example of thicknesses T1-T3 is adopted to simplify the discussion.

In the embodiment shown, the tapering 70 between the second end 64 and the first end 62 primarily occurs at two different rates, a first rate section 76 between the second end 64 and the transition point 77, and a second rate section 78 between the transition point 77 and the first end 62. As shown, the second rate section 78 is greater, or more aggressive, than the first rate section 76. In addition to the tapering 70, the transitions of thickness T are shown to correspond with the differences in length L defined by the scalloping 60 previously discussed. For example, the length L1 between the first end 62 and the second end 64 shown as corresponding to the thickness T1 with respect to tapering 70 also corresponds to the length L1 with respect to scalloping 60. However, the transition points for scalloping 60 need not coincide with these for tapering 70. In the present embodiment, the transition point 77 is actually a transition segment, thereby defining lengths L2 and L3 between respective ends of the transition point 77 and the second end 64 of the rib 50. Likewise, the present embodiment depicts a rib 50 that is symmetrical across a central plane CP defined between the leading surface 72 and trailing surface 74.

It should be recognized that in certain embodiments, the tapering 70 can be described as a continuous curve in the same manner describe with respect to scalloping 60 above. In other words, the rib 50 may have tapering 70 that is continuous, rather than linear, which may be applied over a portion or the entirety of the length L of the rib 50. By way of non-limiting example, the tapering 70 may resemble various V-shapes or U-shapes, which may be symmetrical or non-symmetrical about the center plane CP. In certain embodiments, the tapering 70 and/or scalloping 60 may also incorporate helical twisting (not shown) in addition, or as an alternative, to the tapering 70 and scalloping 60 previously described.

Figure 8:
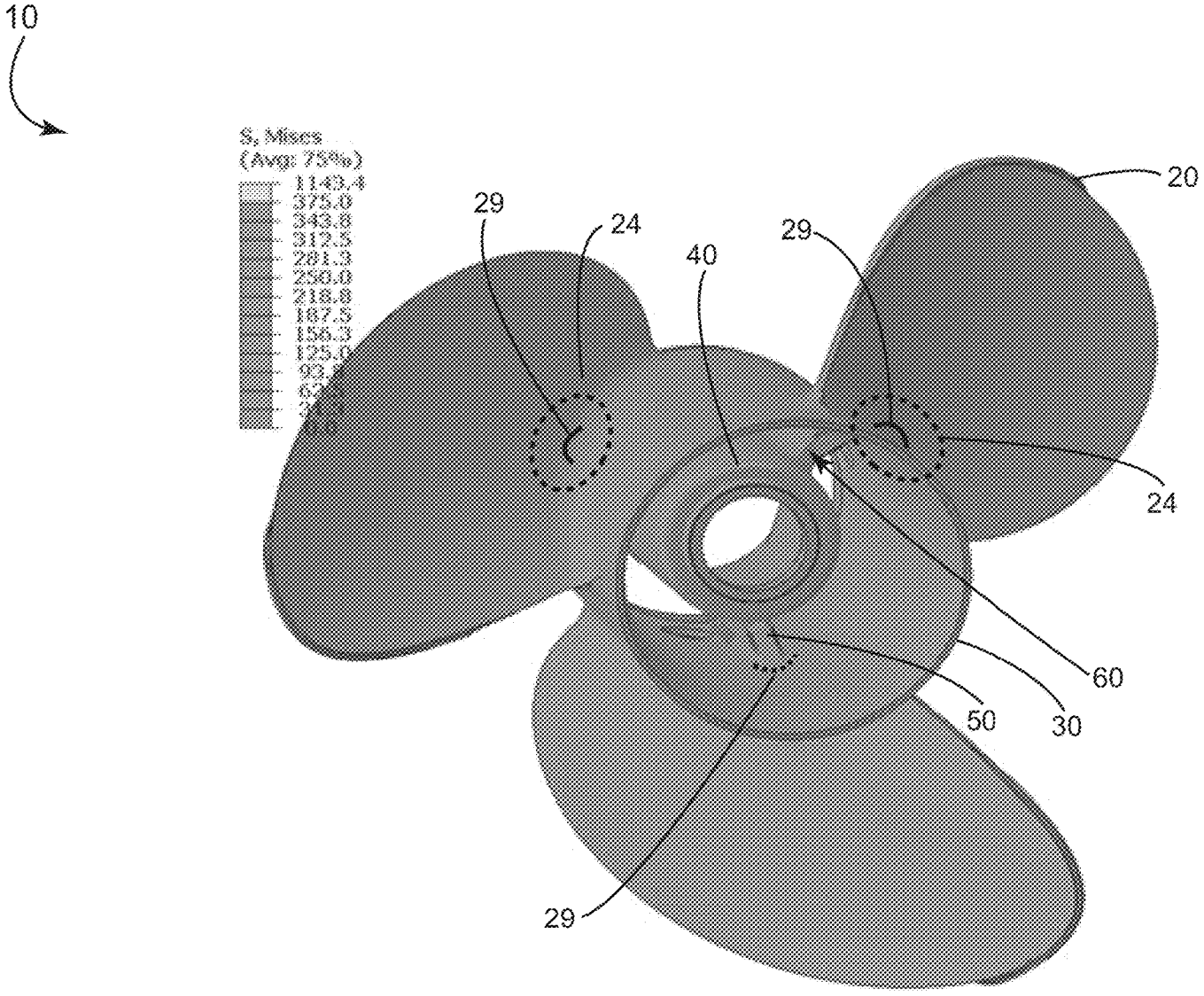
FIG. 8 is an isometric, aft view of another embodiment of a propeller according to the present disclosure.

An exemplary propeller 10 incorporating the design features previously discussed is shown in FIG. 8. Specifically, each of the ribs 50 is coupled to the outer hub 30 such that the blade alignment position 29 overlaps or corresponds to the position in which a blade 20 is also coupled to the outer hub 30. Likewise, each of the ribs 50 incorporates both the scalloping 60 and the tapering 70 previously discussed.

Figure 9:
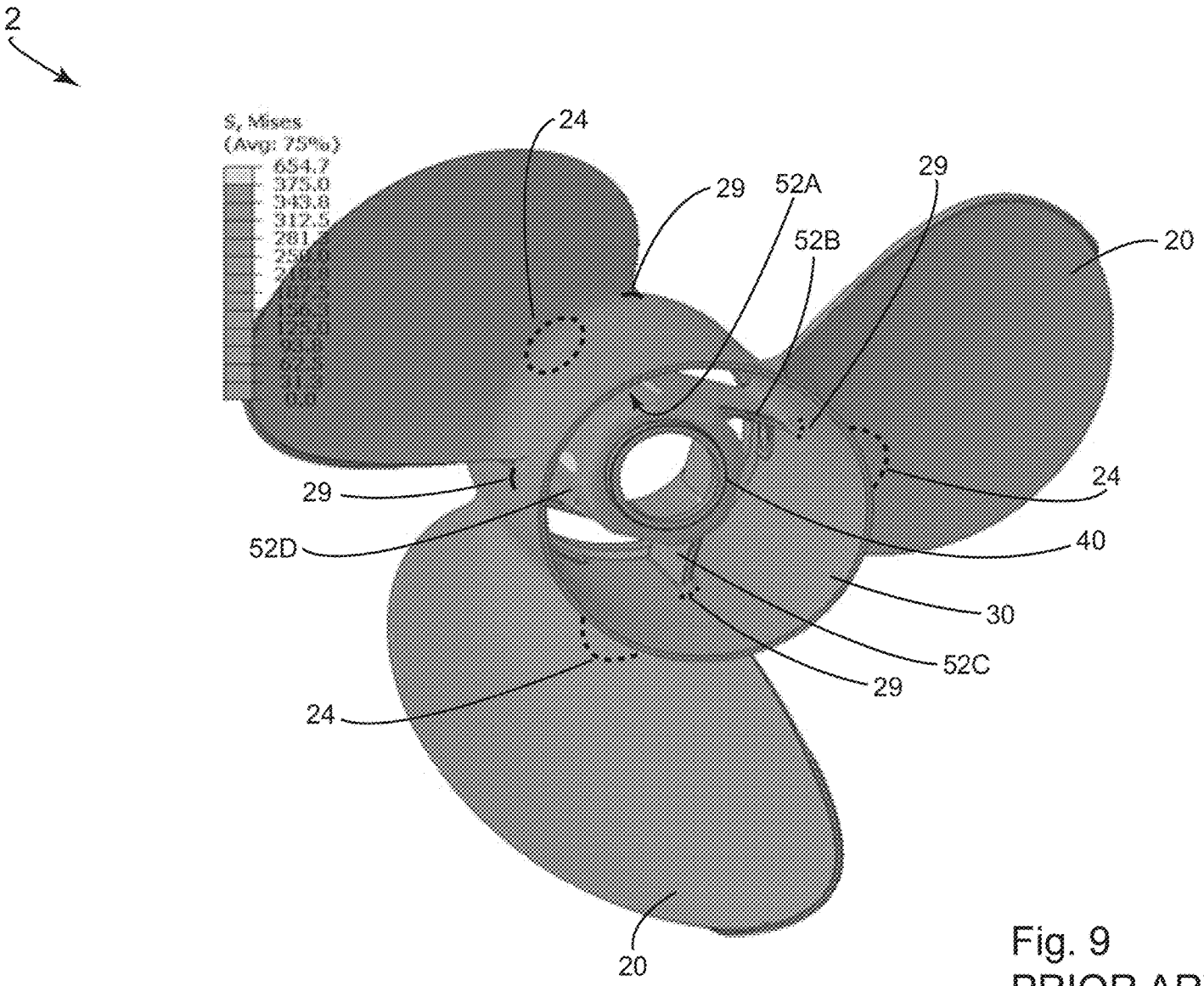
Fig. 9 PRIOR ART
FIG. 9 is an isometric, aft view of another propeller known in the art.

For comparison, the prior art propeller 2 from FIG. 1 is reproduced in FIG. 9 to have the same view as the propeller 10 of FIG. 8. In contrast to the propeller 10 of FIG. 8 according to the present disclosure, the particular prior art propeller 2 shown has four ribs 50 and three blades 20. Accordingly, while some of the ribs 50 are coupled to the outer hub 30 such that the respective blade alignment positions 29 do correspond to a blade 20, others, such as the fourth individual rib 52D, are not in alignment with any blade 20. Moreover, the first individual rib 52A and the third individual rib 52C are shown only barely aligning with a blade 20, specifically at an extreme edge. In the context of a typical propeller blade 20, this would not correspond to the rib 50 aligning to the blade 20 near the thickest region 24 of the blade 20, nor near the center third of the blade 20. The prior art propeller 2 of FIG. 9 further lacks the concurrent scalloping 60 and tapering 70 presently disclosed. Propellers known in the art do not possess all three of the presently disclosed features to thereby improve porosity through controlled material volumes and interactions between the ribs 50, outer hub 30, and blades 20.

Figure 10B:
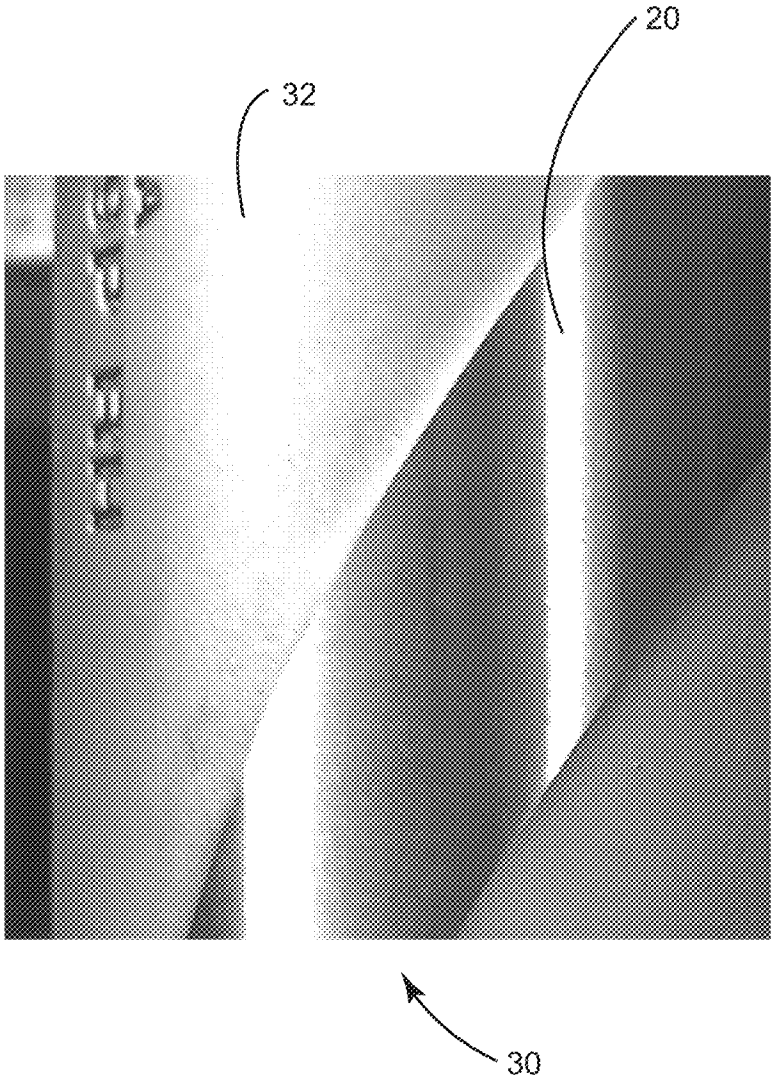
FIGS. 10A and 10B are photographs of the side of an actual propeller made in accordance with the present disclosure with the propeller blades removed to show a lack of porosity in contrast to the prior art propeller shown in FIGS. 3A-3B.
Figure 10A:
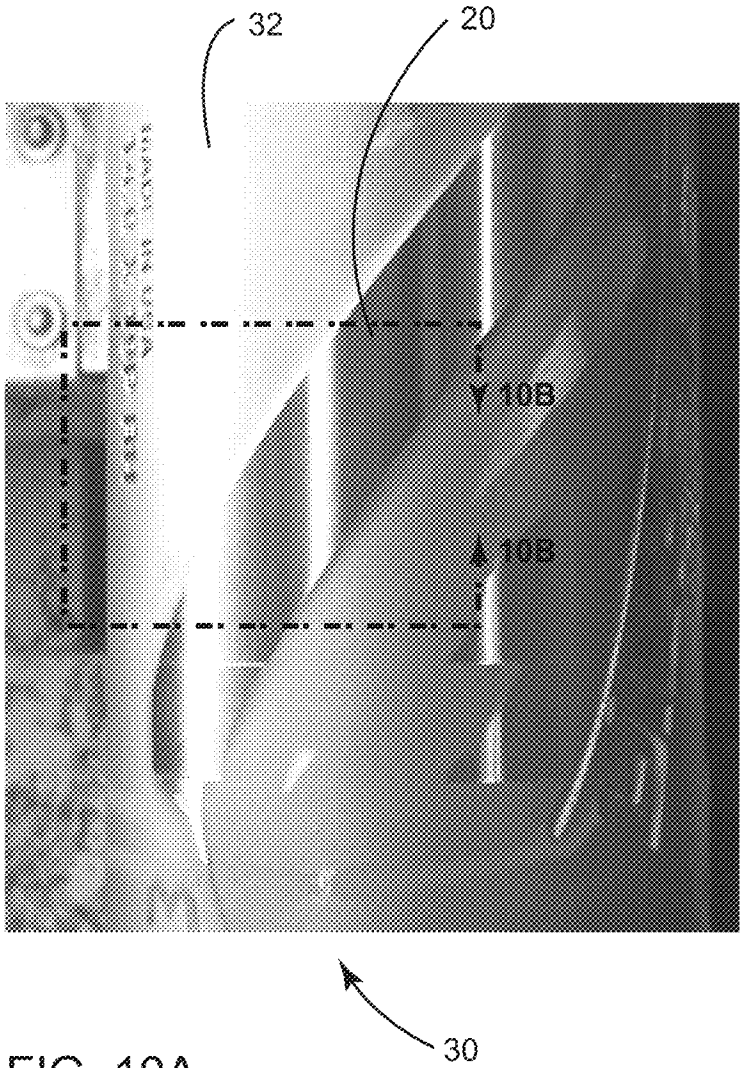

FIGS. 10A and 10B depict actual side view photographs of a propeller made in accordance with the present disclosure. Once again the blades 20 are removed to reveal any underlying defects X as previously seen in FIGS. 3A-3B with respect to prior art propellers 2. As shown, no porosity defects were identified in the propellers 10 made in accordance with the present disclosure, demonstrating the improved solidification profile and consequent reduction of porosity due to shrinkage using the presently disclosed systems and methods.

Figure 11:
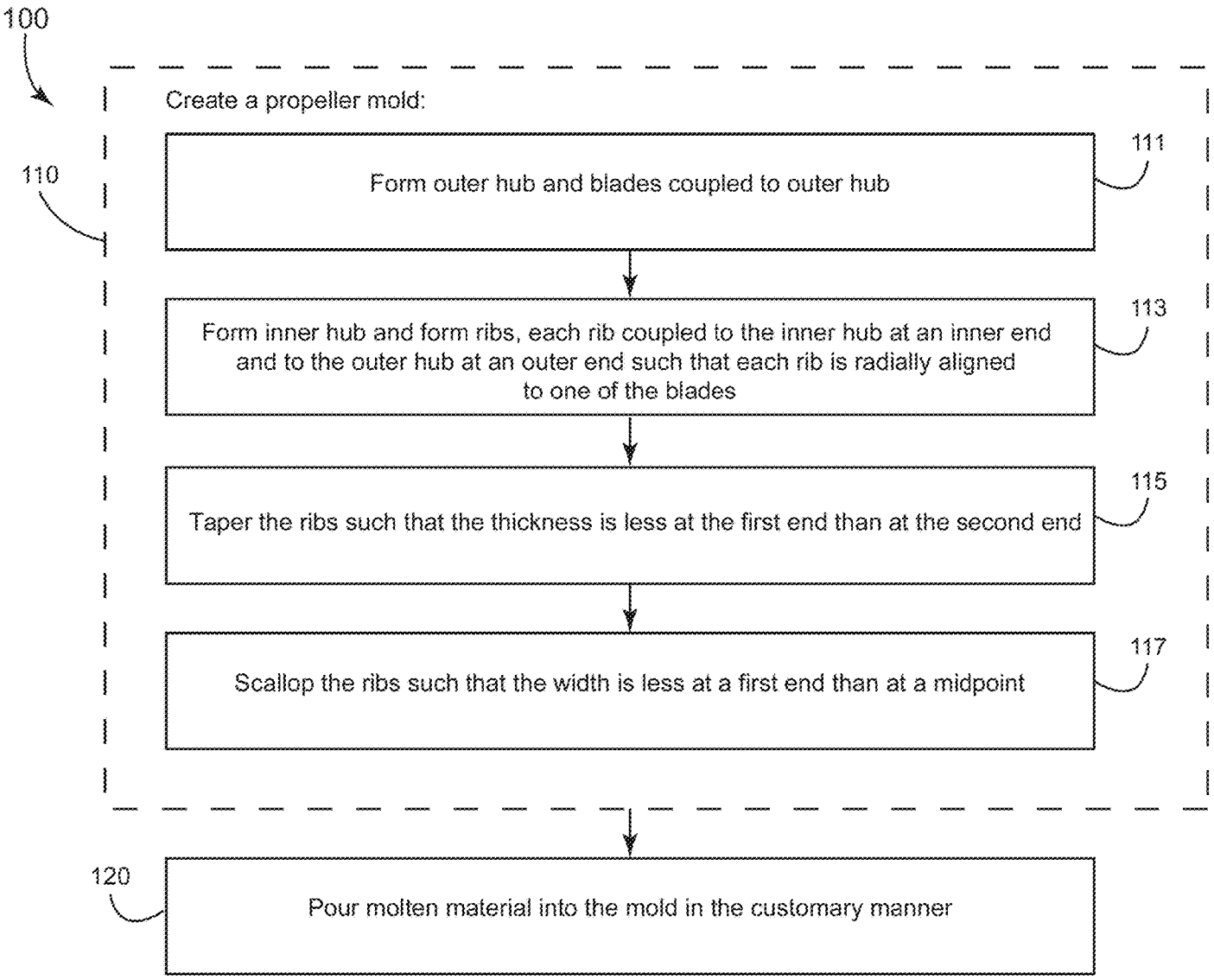
FIG. 11 is an exemplary process flow for making a propeller according to the present disclosure.

FIG. 11 depicts an exemplary process flow for making such a propeller 10 according to the present disclosure. The method 100 includes first creating a propeller mold in step 110. The method 100 includes forming an outer hub and blades coupled to the outer hub in step 111. An inner hub is also formed within the mold, as well as ribs that are each coupled to the inner hub at an inner end and to the outer hub at an outer end such that each rib is radially aligned to one of the blades. In step 115, the ribs are tapered such that the thickness is less at the first end than at the second end, and in step 117 such that the width is less at a first end than at a midpoint between the first end and the second end.

One of ordinary skill in the art will recognize that step 110 includes further sub-steps to produce a propeller mold in the customary manner. In an exemplary process, this would include creating a negative mold (such as of aluminum, but for a propeller 10 possessing the features disclosed herein), injecting wax into the mold to create a positive form of the propeller 10, then coating the wax with ceramic material. The wax is then melted out to create a ceramic shell having an internal negative cavity that again defines the propeller 10 to be cast.

Once the propeller mold is created in step 110, molten material is poured into the mold in step 120 in the customary manner.

The present inventors have identified a 2000 times reduction in porosity of certain propeller configurations produced according to the present disclosure over similar blade 20, rib 50 configurations known in the art.

Moreover, the present inventors have identified that the systems and methods presently disclosed enable alignment of the ribs 50 with the blades 20 even with stainless steel propellers 10, which was previously known in the art to be problematic and is generally avoided. The present inventors have consequently found that by aligning the ribs 50 with the blades 20, the stress profiles of stainless steel propellers 10 are improved, whereby each of the blades 20 is better supported by the ribs 50 in use.

We claim:

1. A method of making a propeller for a marine vessel, the method comprising:

forming the propeller to have blades coupled to an outer hub;

forming the propeller such that the outer hub is coupled to an inner hub via ribs, wherein the inner hub is configured to be coupled to the marine vessel, wherein the ribs each have a first end and a second end that define a length therebetween, wherein a midpoint is further defined between the first end and the second end, wherein the ribs each have an inner end and an outer end that define a width therebetween, and wherein the ribs each have a leading surface and a trailing surface that define a thickness therebetween;

forming each of the ribs to be tapered such that the thickness is greater at the midpoint than at least at one of the first end and the second end;

forming each of the ribs to be scalloped such that the width is greater at the midpoint than at least at one of the first end and the second end, wherein the length between the first end and the second end varies from a smallest length to a greatest length that differ by a delta, and wherein each of the ribs is also scalloped such that the delta is greater than the width at the midpoint; and forming the propeller such that each of the ribs is coupled to the outer hub to be radially aligned with one of the blades.

2. The method according to claim 1, wherein the propeller is configured such that the first end is farther than the second end from the marine vessel when the propeller is coupled thereto, wherein the thickness is greater at the second end than at the first end, and wherein the width is greater at the second end than at the first end.

3. The method according to claim 1, wherein each of the blades has a thickest region, and wherein each of the ribs is radially aligned with the thickest region of one of the blades.

4. The method according to claim 1, wherein each of the blades has a blade width divided into even thirds, and wherein each of the ribs is radially aligned with a center third of the even thirds of one of the blades.

5. The method according to claim 1, wherein the blades are three individual blades, and wherein the ribs are three individual ribs.

6. The method according to claim 1, further comprising forming each of the ribs to also be tapered between the inner end and the outer end such that the thickness is greater at the outer end than at the inner end.

7. The method according to claim 1, wherein the propeller is formed of aluminum.

8. The method according to claim 1, wherein each of the ribs has a center plane that is centrally defined between the leading surface and the trailing surface, and wherein the center plane is perpendicular to both the inner hub and the outer hub.

9. A propeller for a marine vessel, the propeller comprising:

an inner hub configured to be coupled to the marine vessel;

an outer hub and a plurality of ribs that couple the outer hub to the inner hub, wherein the ribs each have a first end and a second end that define a length therebetween, wherein a midpoint is further defined between the first end and the second end, wherein the ribs each have an inner end and an outer end that define a width therebetween, wherein the width is greater at the midpoint than at least at one of the first end and the second end such that the ribs are scalloped, wherein the length between the first end and the second end varies from a smallest length to a greatest length that differ by a delta, and wherein each of the ribs is also scalloped such that the delta is greater than the width at the midpoint, and wherein the ribs each have a leading surface and a trailing surface that define a thickness therebetween, wherein the thickness is greater at the midpoint than at least at one of the first end and the second end such that the ribs are tapered; and a plurality of blades that are coupled to the outer hub;

wherein each of the ribs is coupled to the outer hub in radial alignment with one of the blades.

10. The propeller according to claim 9, wherein the propeller is configured such that the first end is farther than the second end from the marine vessel when the propeller is coupled thereto, wherein the thickness is greater at the second end than at the first end, and wherein the width is greater at the second end than at the first end.

11. The propeller according to claim 9, wherein each of the blades has a thickest region, and wherein each of the ribs is radially aligned with the thickest region of one of the blades.

12. The propeller according to claim 9, wherein each of the blades has a blade width divided into even thirds, and wherein each of the ribs is radially aligned with a center third of the even thirds of one of the blades.

13. The propeller according to claim 9, wherein the blades are three individual blades, and wherein the ribs are three individual ribs.

14. The propeller according to claim 9, further comprising forming each of the ribs to also be tapered between the inner end and the outer end such that the thickness is greater at the outer end than at the inner end.

15. The propeller according to claim 9, wherein the propeller is formed of aluminum.

16. The propeller according to claim 9, wherein each of the ribs has a center plane that is centrally defined between the leading surface and the trailing surface, and wherein the center plane is perpendicular to both the inner hub and the outer hub.

17. A method of making a propeller for a marine vessel, the method comprising:

forming the propeller to have blades coupled to an outer hub;

forming the propeller such that the outer hub is coupled to an inner hub via ribs, wherein the inner hub is configured to be coupled to the marine vessel, wherein the ribs each have a first end and a second end that define a length therebetween, wherein a midpoint is further defined between the first end and the second end, wherein the ribs each have an inner end and an outer end that define a width therebetween, and wherein the ribs each have a leading surface and a trailing surface that define a thickness therebetween;

forming each of the ribs to be tapered such that the thickness is greater at the midpoint than at least at one of the first end and the second end;

forming each of the ribs to be scalloped such that the width is greater at the midpoint than at least at one of the first end and the second end; and forming the propeller such that each of the ribs is coupled to the outer hub to be radially aligned with one of the blades;

wherein the thickness decreases at a first rate between the second end and the midpoint, and the thickness decreases at a second rate between the midpoint and the first end, wherein the second rate is greater than the first rate.

18. A propeller for a marine vessel, the propeller comprising:

an inner hub configured to be coupled to the marine vessel;

an outer hub and a plurality of ribs that couple the outer hub to the inner hub, wherein the ribs each have a first end and a second end that define a length therebetween, wherein a midpoint is further defined between the first end and the second end, wherein the ribs each have an inner end and an outer end that define a width therebetween, wherein the width is greater at the midpoint than at least one of the first end and the second end such that the ribs are scalloped, and wherein the ribs each have a leading surface and a trailing surface that define a thickness therebetween, wherein the thickness is greater at the midpoint than at least one of the first end and the second end such that the ribs are tapered; and a plurality of blades that are coupled to the outer hub;

wherein each of the ribs is coupled to the outer hub in radial alignment with one of the blades; and wherein the thickness decreases at a first rate between the second end and the midpoint, and the thickness decreases at a second rate between the midpoint and the first end, wherein the second rate is greater than the first rate.

19. A propeller for a marine vessel, the propeller comprising:

an inner hub configured to be coupled to the marine vessel;

an outer hub and a plurality of ribs that couple the outer hub to the inner hub, wherein the ribs each have a first end and a second end that define a length therebetween, wherein a midpoint is further defined between the first end and the second end, wherein the ribs each have an inner end and an outer end that define a width therebetween, wherein the width is greater at the midpoint than at least at one of the first end and the second end such that the ribs are scalloped, and wherein the ribs each have a leading surface and a trailing surface that define a thickness therebetween, wherein the thickness is greater at the midpoint than at least at one of the first end and the second end such that the ribs are tapered; and a plurality of blades that are coupled to the outer hub;

wherein each of the ribs is coupled to the outer hub in radial alignment with one of the blades; and wherein the propeller is configured such that the first end is farther than the second end from the marine vessel when the propeller is coupled thereto, wherein the thickness decreases at a first rate between the second end and the midpoint, wherein the thickness decreases at a second rate between the midpoint and the first end, wherein the second rate is greater than the first rate, and wherein each of the blades has a thickest region and each of the ribs is radially aligned with the thickest region of one of the blades.

20. A method of making a propeller for a marine vessel, the method comprising:

forming the propeller to have blades coupled to an outer hub;

forming the propeller such that the outer hub is coupled to an inner hub via ribs, wherein the inner hub is configured to be coupled to the marine vessel, wherein the ribs each have a forward end and an aft end that define a length therebetween, wherein a midpoint is further defined between the forward end and the aft end, wherein the ribs each have an inner end and an outer end that define a width therebetween, wherein the ribs each have a leading surface and a trailing surface that define a thickness therebetween;

forming each of the ribs to be tapered such that the thickness decreases at a first rate between the forward end and the midpoint, and the thickness decreases at a second rate between the midpoint and the aft end, wherein the second rate is greater than the first rate;

forming each of the ribs to be scalloped such that the width continuously increases from the aft end to the midpoint; and forming the propeller such that each of the blades has a blade width divided into even thirds, and such that each of the ribs is radially aligned with a center third of the even thirds of one of the blades.

* * * * *